US007100219B2

(12) United States Patent
Kajlich

(10) Patent No.: US 7,100,219 B2
(45) Date of Patent: Sep. 5, 2006

(54) EQUIPMENT FOR FASTER SWIMMING POOLS

(76) Inventor: Anton Kajlich, 65 Twelfth Avenue, St Lucia, QLD 4067 (AU)

( * ) Notice: Subject to any disclaimer, the term of this patent is extended or adjusted under 35 U.S.C. 154(b) by 0 days.

(21) Appl. No.: 10/380,355

(22) PCT Filed: Sep. 13, 2001

(86) PCT No.: PCT/AU01/01152

§ 371 (c)(1),
(2), (4) Date: Mar. 13, 2003

(87) PCT Pub. No.: WO02/22992

PCT Pub. Date: Mar. 21, 2002

(65) Prior Publication Data

US 2004/0031093 A1 Feb. 19, 2004

(30) Foreign Application Priority Data

Sep. 13, 2000 (AU) ..... PR0076

(51) Int. Cl.
*E04H 4/14* (2006.01)

(52) U.S. Cl. ..... 4/497; 4/505

(58) Field of Classification Search ..... 4/497, 4/505

See application file for complete search history.

(56) References Cited

U.S. PATENT DOCUMENTS

| | | | | | |
|---|---|---|---|---|---|
| 3,540,063 | A | * | 11/1970 | Stanwood | 4/497 |
| 3,786,521 | A | | 1/1974 | Walket | |
| 3,886,602 | A | * | 6/1975 | Stanwood | 4/497 |
| 4,616,369 | A | * | 10/1986 | Rademacher | 4/497 |
| 5,520,562 | A | | 5/1996 | Eddy | |

FOREIGN PATENT DOCUMENTS

| | | |
|---|---|---|
| FR | 2280765 | 2/1976 |
| FR | 2 742 464 | 6/1997 |
| JP | 08071260 | 3/1996 |
| SE | 8903-446 | 4/1991 |
| WO | WO96/19628 | 6/1996 |
| WO | WO97/21889 | 6/1997 |

* cited by examiner

*Primary Examiner*—Robert M. Fetsuga
(74) *Attorney, Agent, or Firm*—Michael Best & Friedrich

(57) ABSTRACT

A wave inhibiting device (10) for a pool lane divider, the device having an inner region, a plurality of fins (16, 17) extending from the inner region and for blocking at least a portion of any wave incident on a major surface thereof, and an outer region having at least one peripheral wall (19) which extends at least part way between adjacent fins and has at least one wall portion with an inner face which is adapted to block at least a portion of any wave incident on an inner surface thereof.

6 Claims, 8 Drawing Sheets

EQUIPMENT FOR FASTER SWIMMING POOLS

FIELD OF THE INVENTION

The preset invention relates to developments in swimming pool technology.

It particular the invention relates to various types of accessories which are used in or with swiping pools.

BACKGROUND OF THE INVENTION

For the sport of competitive swimming, the "speed" of a swimming pool is an important factor contributing to the ability of swimmers to swim fast and possibly achieve a personal best time.

Various theories exist as to what constitutes a "fast" pool, but at present there are no established parameters for making a pool fast".

The inventor has observed that various factors contribute to whether a pool can be made "faster". One of these observations is that the amount of wave activity in a pool can result in a swimmer experiencing a "drag".

SUMMARY OF THE INVENTION

According to one aspect of the present invention there is provided a wave inhibiting device for a pool lane divider, the device having an inner region, a plurality of fins extending from the inner region and for blocking at least a portion of any wave incident on a major surface thereof, and an outer region having at least one peripheral wall which extends at least part way between adjacent fins and has at least one wall portion with an inner face which is adapted to block at least a portion of any wave incident on an inner surface thereof.

Preferably at least some of the at least one peripheral wall portions face at least one major face of one of the plurality of fins Preferably each peripheral wall portion extends between outer ends of each adjacent fin.

Preferably an inner face of each peripheral wall portion faces the major faces of the two fins across which it extends.

It is preferred that each peripheral wall portion is oriented at an angle of 90° or less to an adjacent fin Preferably a major face of at least one of the peripheral wall portions faces a major face of one fin.

A major face of each peripheral wall portion preferably faces a major face of one fin.

It is preferred that each fin is adapted to direct a wave incident thereon towards the inner face of an adjacent peripheral wall portion.

It is preferred that each wall portion is adapted to inhibit the amplitude of any wave incident on one of the fins.

Preferably the device has a central axial portion.

Preferably the fins radiate from the central axial portion.

The central axial portion may be adapted to receive a line for securing a plurality of the devices together to form a pool lane divider.

According to another embodiment the device includes a line receiving portion which is located at a peripheral region of the device.

Preferably the fins extend at substantially right angles to each other.

The device may include a plurality of annular walls surrounding the central axial portion.

Each of the annular walls are preferably connected to an adjacent annular wall at inner end regions of each fin.

Each annular wall preferably includes a peripheral lip portion.

Preferably each annular wall has peripheral lip portions on opposing faces thereof.

It is preferred that an annular wall is separated from an adjacent annular wall by at least one arcuate slot.

According to one embodiment each annular wall is separated from an adjacent annular wall by a plurality of arcuate slots arranged in a ring like pattern.

The peripheral lip may extend axially on either side of the annular wall.

Preferably the device includes a plurality of arcuate wall segments arranged in a ring like pattern and separated by spaces.

Preferably each arcuate wall segment has lateral wall portions.

The lateral wall portions preferably extend axially at inner and outer ends of each face thereof.

Each arcuate wall preferably extends between adjacent fins.

Each peripheral wall portion preferably comprises axially directed extensions.

Preferably adjacent peripheral wall extensions are directed in opposite axial directions.

Each axially directed extension preferably comprises an arcuate wave like extension.

Adjacent peripheral wall extensions may be spaced apart by 45°.

Adjacent peripheral wall extensions facing the same axial direction are preferably separated by approximately 90°.

It is preferred that each peripheral wall portion comprises short and long axially directed wall portions.

It is preferred that each wall portion is a generally thin wall.

It is preferred that the peripheral wall extends around the outer ends of each fin and includes wall portions which are directed in opposite axial directions.

According to one embodiment the device comprises a first plurality of fins on one axial side of the inner region and a second plurality of fins on an opposite side of the inner region.

It is preferred that the first plurality of fins are arranged axially at 45° with respect to the second plurality of fins.

It is preferred that one of the plurality of fins comprise generally rectangular fins.

It is preferred that one of the plurality of fins comprises generally rectangular fins with scalloped regions in outer side edges thereof.

It is preferred that the peripheral wall includes a plurality of peaks and troughs.

It is preferred that the peripheral wall is in the form of a circumferential wall having the same axial direction as the fins.

It is preferred that the axial length of portions of the peripheral wall are less than the axial length of the fins.

It is preferred that the length of the continuous wall in the axial direction is less than the length of an, opposite fin.

It is preferred that the device is adapted to mitigate propagation of waves striking a fin or peripheral wall.

According to another embodiment of the present invention the device includes a wave energy absorption means.

The wave energy absorption means may include a sponge-like member.

Preferably the wave energy absorption means includes finger-like projections extending from major faces of any one or more of the fins or peripheral wall portions.

It is preferred that the device includes a flotation means for assisting in buoyancy of the device.

According to a second aspect of the present invention there is provided a wave inhibitor for a pool comprising a support having a plurality of flexible elongate members extending therefrom.

It is preferred that the support comprises a base.

Preferably the support comprises a generally planar mat.

The flexible elongate members may be arranged to form a wall.

Preferably the flexible elongate members are arranged in one or more closed loops.

The flexible elongate members may be arranged in closely packed rows and columns.

According to one embodiment the wave inhibitor comprises a plurality of mats each having a plurality of flexible elongate layers extending therefrom.

Preferably the plurality of mats are arranged along the length of a pool lane on the bottom of a pool.

Preferably each elongate member comprises a stem with a flotation means.

The flotation means may comprise an air sack or buoyancy device.

The flotation means is preferably located at the top of the step.

Preferably each elongate member includes a plurality of damping portions.

The damping portions may be frond-like portions.

It is preferred that the damping portion are flexible.

According to an alternative embodiment the support may be a line such as wire or cord.

Preferably the elongate members are suspended from the line.

The support may be suspended across at least part of a pool with the elongate members hanging therefrom in the pool.

According to one embodiment the wave inhibitor forms a curtain.

According to another embodiment the wave inhibitor comprises a net.

The support may be a net.

The elongate members according to one embodiment may be a plurality of bristles on a support which is adapted to be located on any wall of a pool.

According to a third aspect of the present invention there is provided a wave inhibitor for a pool comprising a body having art upper surface with a curved peak for inhibiting waves incident thereon.

Preferably the wave inhibitor has a curved ridge which is adapted to deflect incident waves from above at an angle of substantially 90° away therefrom.

It is preferred that the curved peak is a ridge which extends across the width of the pool when located in a pool.

Preferably the peak comprises a curved ridge.

Preferably the wave inhibitor includes a curved trough substantially in parallel and adjacent to the curved ridge.

The body may have a plurality of parallel curved ridges and curved troughs.

Preferably the body comprises a portable block or mat with a preformed upper surface profile.

Preferably the peak is adapted to direct wave flow substantially parallel to a horizontal plane.

According to one embodiment the wave inhibitor of the third aspect may be used in conjunction with the wave inhibitor of the second aspect of the invention.

According to one embodiment the wave inhibitor comprises a plurality of parallel peaks arranged in rows and columns of peaks.

According to a fourth aspect of the present invention there is provided a lane divider comprising a net which is suspended across the bottom of a pool, the net including damping means for absorbing ware energy.

The not may also be suspended by a line to form a lane divider.

It is preferred that the net includes outer layers with an energy absorbing layer sandwiched therebetween.

The wave inhibitor according to the third aspect of the invention may be attached to sides of a pool to deflect waves to the bottom of the pool.

According to a fifth aspect of the present invention there is provided a wall adaptor for a pool comprising an attachment portion for attaching the adaptor to a side of a pool, at least one step for climbing out of the pool and wherein the attachment portion is adapted to fit over at least part of an overflow drain of a pool.

The adaptor may include an inclined wall for covering one side wall of the overflow gutter.

Preferably the adaptor forms a wall portion of a side wall of the pool to which it is attached.

Preferably the detachment portion comprises a hook portion.

It is preferred that the wall adaptor is a moulded body.

According to a sixth aspect of the present invention there is provided a wall module for a pool comprising an elongate body having opposite ends each with a connection means for removably connecting the module to a securing means to fix the module across at least part of a pool.

Preferably the wall module is adapted to be located across the width of a pool to reduce the length of the pool.

The elongate body may comprise a generally rectangular block.

Preferably the connection means comprises coupling portions underneath each end portion of the module.

The wall module may comprise a movable bulk head.

Preferably the coupling portion comprises female/male portions which are adapted to couple with matching male/female portions located in the pool decking area.

The female portions may comprise holes adapted to receive rods/spigots or the like in a recessed area adjacent an edge of the pool.

The wall module preferably includes end supports to allow lifting devices to fit underneath the module.

The wall module may include supporting feet for supporting the wall module when it is not located across at least part of the pool.

The wall module preferably includes starting blocks.

According to a seventh aspect of the present intention there is provided a starting block for a pool comprising a base for standing on and a pair of handles, wherein each handle includes a quick release handle portion for permitting a swimmer to push-off or lean forward prior to a diving start into the pool, wherein a quick release handle portion comprises a knob.

According to another variation of the present invention the quick release handle portion comprises a recess in the handle which recess is able to receive a person's hand.

Preferably the knob is located on an upper surface of the handle.

The handle portion may protrude beyond a main part of the handle.

The handle portion preferably is shaped to permit an easy push-release for a swimmer holding it.

The handle may be movable to adjust its position.

It is preferred that the handle portion is shaped so that the palm of the person's hand fits over the top of it and the fingers are generally splayed when gripping onto the edges of the knob.

Preferably the handle may slide forward or back The handle may be able to lift or drop to a desired height.

According to one embodiment the handle includes locking means for locking its position.

Each handle may be located on a sliding mechanism.

Preferably both handles are fixed to a movable platform.

According to an eighth aspect of the present invention there is provided a starting block for a pool comprising a base for standing on a locking means, wherein the base is able to slide forward or rearward and is able to be fixed in a plurality of different positions by the looking means.

Preferably the base includes foot portions for providing an obstacle to rearward slippage of a foot as a swimmer dives into the pool.

The foot portions may include a heel wall for pushing the back of a person's heel against during a diving start.

The foot portions are preferably upstanding wall portions.

Each wall portion may be independently slidable forward or rearwardly.

According to another aspect of the present invention there is provided a partition or false wall for a pool comprising a plurality of openings in an upper face thereof.

According to a further aspect of the present invention there is provided a wave inhibitor comprising a plurality of water jets directed from at least one side wall of a pool.

Preferably the plurality of water jets are adapted to counteract wave flow in a swimming pool.

According to one embodiment the water jets are arranged to spray water along the surface of the water level of a swimming pool.

According to one embodiment there is provided a wall for a swimming pool having a plurality of water jet nozzles facing outwardly therefrom.

Preferably the water nozzles are connected to a conduit system which in connectable to a pump for forcing water from each of the water nozzles.

According to another aspect of the present invention there is provided a wave inhibitor comprising a barrier having a plurality of openings in an upper face thereof.

The barrier preferably comprises a plurality of slots.

The barrier may comprise a plurality of parallel slats with adjacent slats being separated by a gap.

The slats may be movable to open and close.

The barrier may comprise a plurality of parallel louvres.

The barrier preferably is adapted to form a floor or side wall of a pool.

It is preferred that the barrier or partition is spaced apart from a wall or floor of a pool.

Preferably the barrier or partition includes a frame support for supporting the barrier or partition when it is located in a pool.

According to one embodiment the barrier or partition is suspended at least 2.5 meters below the surface of the water.

According to another embodiment the barrier is placed across the pool floor approximately 2.5 meters below the surface of the water. In such a situation the barrier may be supported on legs above the pool floor or it may be suspended from above.

According to another embodiment the barrier or partition enables a substantial amount of wave activity to pass therethrough into a water space behind the barrier.

The barrier may be in the form of a screen with a plurality of holes therethrough.

Preferably the barrier includes deflector walls for deflecting waves through the barrier but for preventing waves from easily passing back into the main pool after passing through the barrier.

It is preferred that the slats or louvres are angled to assist in movement of waves in one direction only through the gaps created therebetween.

According to another aspect of the present invention there is provided a pool having at least one false wall, the false wall comprising a partition spaced from a bulkhead wall of the pool, whereby water is able to flow through the partition to a space behind it.

It is preferred that the false wall is located above the floor of the pool.

Preferably the partition is suspended a predetermined distance from a pool wall.

The partition may be supported a predetermined distance from a pool wall.

The words "comprising, having, including" should be interpreted in an inclusive sense, meaning that additional features may also be added.

According to a further aspect of the present invention there is provided a wall module for a pool, the wall module comprising first and second wall portions which are connected together so that the first wall portion is movable with respect to the second wall portion.

It is preferred that the first wall portion is pivotally connected to the second wall portion.

Preferably each wall portion is adapted to act as a false wall for a swimming pool.

Preferably the first wall portion is pivotable to a position substantially at 90° with the second wall portion.

According to one embodiment at least one wall portion includes a wave suppression means.

It is preferred that the wall module includes a support means for supporting it on the floor of a pool.

Preferably the support means comprises legs which support the wall module a predetermined distance above the bottom of the pool.

Preferably the support means includes inflatable.

According to one embodiment of the present invention there is provided a plurality of wall modules arranged in a swimming pool to partition at least part of the swimming pool.

It is preferred that the wall module is suspended a predetermined distance above the floor of a swimming pool so that water is able to pass therebelow.

According to another embodiment at least one wall portion is connected to the other wall portion through connecting legs.

Preferably the one wall portion with connecting legs is able to be pivoted to a vertical position whereby a top surface of the one wall portion protrudes beyond the surface of the water level of the pool.

It is preferred that the one wall portion has a space between the legs which permits water to flow thereunder.

Preferably at least one wall portion includes openings to allow water to pass therethrough.

According to another embodiment at least one wall portion includes flow through panels having a plurality of slots which allow water to pass therethrough.

It is preferred that the one wall portion includes a plurality of openings arranged along the surface of the water level so that waves pass through the openings. Preferably each opening includes a wave damping means.

The words "comprising, having, including" should be interpreted in an inclusive sense, meaning that additional features may also be added.

BRIEF DESCRIPTION OF THE DRAWINGS

Preferred embodiments of the different aspects of the present invention will now be described by way of example only with reference to the accompanying drawings in which.

DETAILED DESCRIPTION OF THE DRAWINGS

Figure 1A:
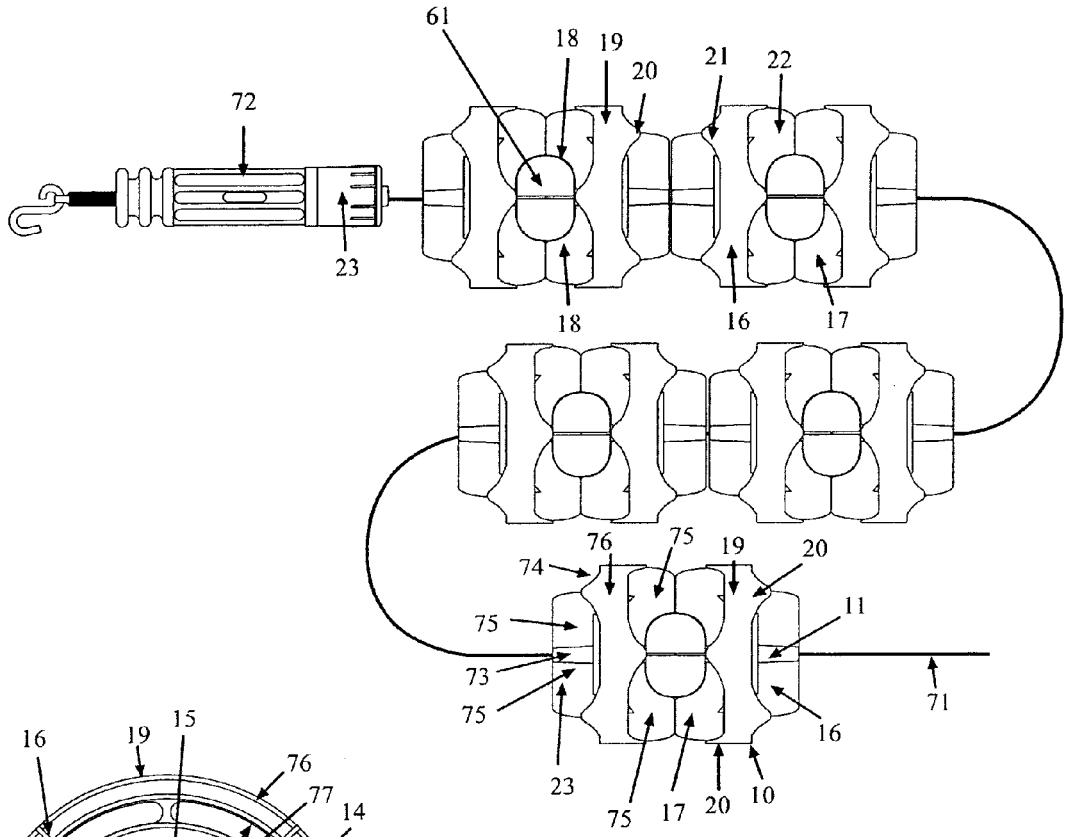
FIGS. 1*a*, 1*b*, and 1*c* show a wave inhibiting device for a pool lane divider according to the first aspect of the present invention.
Figure 1B:
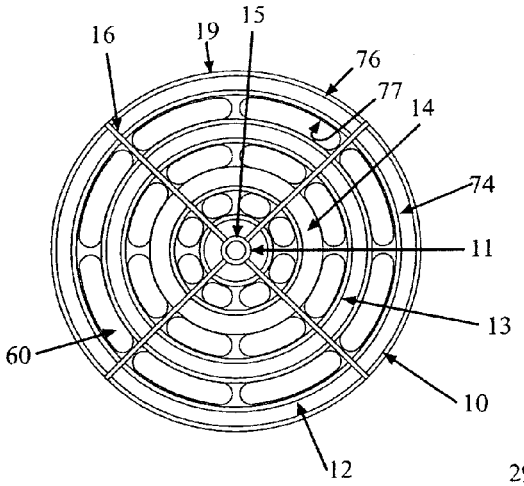
Figure 1C:
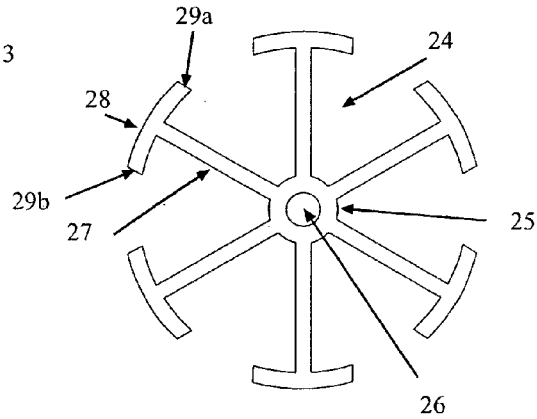

The wave inhibiting device 10 shown in FIG. 1 consists of a central a cylindrical tube 11 with four concentric rings 12, 13, 14, 15.

The divider 10 also includes four radiating fins 16 on one side of the concentric rings 12, 13, 14, 15 and another four radiating fins 17 on the other side of the concentric rings 12, 13, 14, 15.

The fin 16 on one side of the concentric rings consist of four individual fins arranged in a cross configuration. On the other side of the concentric rings the fins 17 are also arranged in a cross configuration.

The fins 16 are essentially rectangular in shape and are oriented so that each fin 16 is at an angle of 45° with respect to adjacent fins 17 on the other side of the concentric rings.

The fins 17, like the fins 16 are of the same basic shape but have scalloped out semi-circular recesses 18 in their outer side edges.

Each device 10 is also provided with an outer circumferential wall 19 which extends axially on both sides of the concentric rings.

The axial facing edge of each side of circumferential wall 19, has a series of rounded peaks 20 or castellations. There are four peaks in total and each peak 20 is bisected by a outer edge of one of the fins 16,17.

Consequently the peaks 20 on both sides of circumferential wall 19 are spaced 45° apart.

Each peak 20 is separated from am adjacent peak 20 by a generally flat valley 23 having a small axial width.

Each peak 20 preferably has a height (axial length) which extends at least partially along the outer peripheral edge 21 and 22 of fine 16 and 17. If the peaks 20 extend along the whole axial length of the peripheral edges 21, 22 this minimises wave propagation.

Each of the rings 12 to 15 are connected together along the inner edge of each of the fins 16, 17.

Consequently each ring is separated from an adjacent ring by a series of eight slots 60.

The slots between the outermost rings 12, 13 are longer than the slots between the innermost rings.

In use a number of the dividers 10 are connected together by threading a wire cable through each tube 11. Adjacent dividers 10 are arranged so that like fins are facing each other. With this configuration it is possible to place a float 61 between the adjacent fins having the scalloped regions 18.

A special tensioner 72 is connected to one end of the cable 71 and includes a tightening screw 23 at one end which is able to be screwed to tighten the cable 71 so that the lane dividers 10 are held as close as possible to a horizontal disposition.

It is preferred that the radial length of the fins 16 are the same as the radial length of the fins 17. in addition the fins 16, 17 may be angled slightly away from the central axis defined by tensioner 72 so that waves are more likely to deflect with an axial component which can be more easily trapped within the walls 19 and fins 16, 17 of the wave inhibiting device 10.

The lane dividers 10 connected together as described above provide a means of inhibiting wave reflection back into a pool lane. This is because a wave travelling laterally strikes fins 16 wad 17 which are in a generally upright orientation and reflect back to the opposing outer circumferential wall 19. The wave is thus captured between the peaks 20 and the fins 16, 17 and to a lesser extent by the valleys or troughs 23. Furthermore the amplitude of each wave is suppressed by that part of the outer circumferential wall 19 which is located above the wave.

In addition to the above because the outer circumferential wall is continuous all parts of a wave are effectively captured and suppressed within the confines of adjacent fins and the outer circumferential wall portions 19.

It is also noted that each of the rings has outer and inner peripheral axial wall portions on both side faces thereof which also assist with mitigating wave movement.

Accordingly, some embodiments of the present invention provide a wave inhibiting device 10 for a pool lane divider, the device 10 having an inner region 73, a plurality of fins 16, 17 extending from the inner region and for blocking at least a portion of any wave incident on a major surface 75 thereof, and an outer region 74 having at least one circumferential or peripheral wall 19 which extends at least part way between adjacent fins 16, 17 and has at least one wall portion 76 with an inner face 77 which is adapted to block at least a portion of any wave incident on an inner surface thereof. Also, in some embodiments, the peripheral wall portions 76 comprise axially directed extensions (e.g., peaks 20 or castellations).

According to another embodiment a wave inhibiting device 24 is made so that it can be single extruded plastics material or similar.

The device 24 consists of a cylindrical core 25 having a central axial passage 26 therethrough. A number of fins 27 extend radially from the surface of the cylindrical core 25 and at their outer ends are provided with transverse walls 28 to give the fins 27 a T-shaped configuration. The number and size of the fins 27 may be varied to suit the situation.

Each of the walls 28 may be provided with a wavy upper and/or lower axial wall 29*a*, 29*b* As with the previous embodiment the device 24 is adapted to allow propagation of waves towards the central core 25 so that waves are reflected and captured between adjacent fins 27 and their walls 28.

It is preferred that the devices 24 are made as a number of separate devices which are able to rotate with respect to each other when located over a tensioning line 21. Alternatively a single piece extrusion could be made with the fins extruded with the central core 25 or alternatively the core provided with external slots which allow the fins to be connected therein. This connection may be achieved by providing a T-shaped inner end which fits into a T-shaped groove in the outer periphery of the central core 25. A number of this grooves may be provided around the periphery of the central core 25 so that a number of fins may be attached.

According to a second aspect of the present invention as shown in FIGS. 2 to 5, a wave inhibitor 30 can be provided in the form of a planar base mat or panel element 31 with a multitude of upwardly extending flexible stems 32 extending therefrom.

The top of each stem 32 is provided with a flotation element 33 so that each flexible stem is maintained in an essentially upright position.

According to one embodiment of this aspect of the invention, each flexible stem is provided with a number of flexible fronds.

Figure 5:
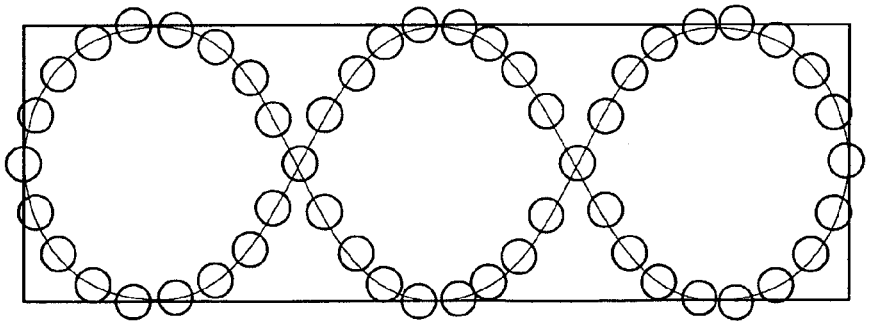
FIG. 5 shows an arrangement of wave inhibitors of the type shown in FIG. 2.

According to one embodiment of this aspect of the invention the flexible stems may be arranged in helical loop patterns as shown in FIG. 5.

The mats 31 could be in the form of a carpet which is able to be laid over the floor of a pool.

The stems may be approximately 300 mm long and may be coloured so as to represent racing lane patterns which would normally be represented by tiles or painting.

The objective of the above described wave inhibitor is to provide a method of inhibiting wave movement through a pool. This is provided by the flexible stems acting as dampers which mitigate movement of waves or turbulence. The properties of the stems may be adjusted to enhance the ability of the stems to absorb wave energy.

The fronds offer a method of providing more surface area to a wave approaching the stems. These fronds 34 may be replaced by variations which assist in damping wave movement.

Figure 6:
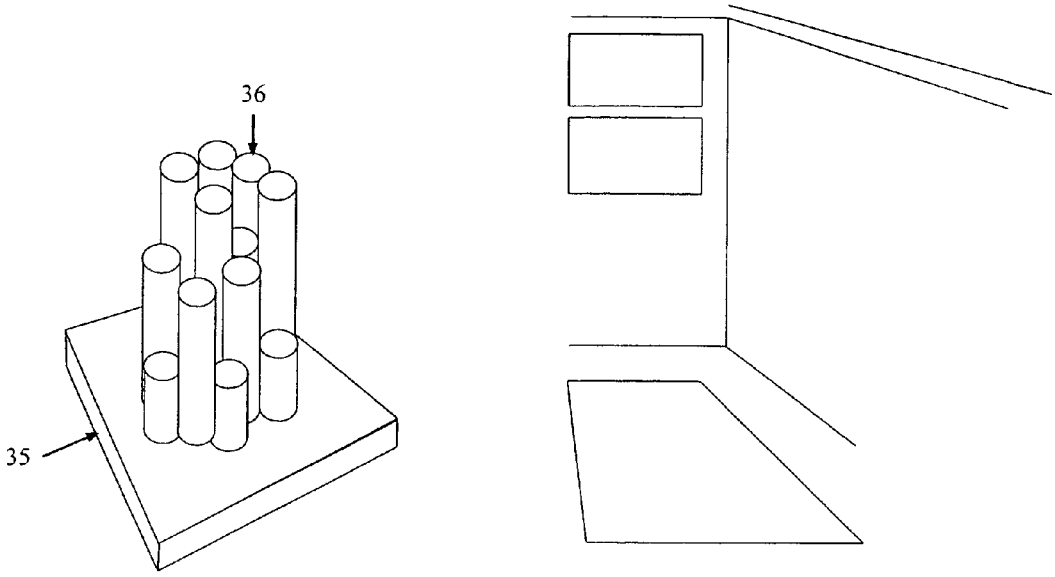
FIG. 6 shows a second embodiment of a wave inhibitor according to the second aspect of the present invention.
Figure 7:
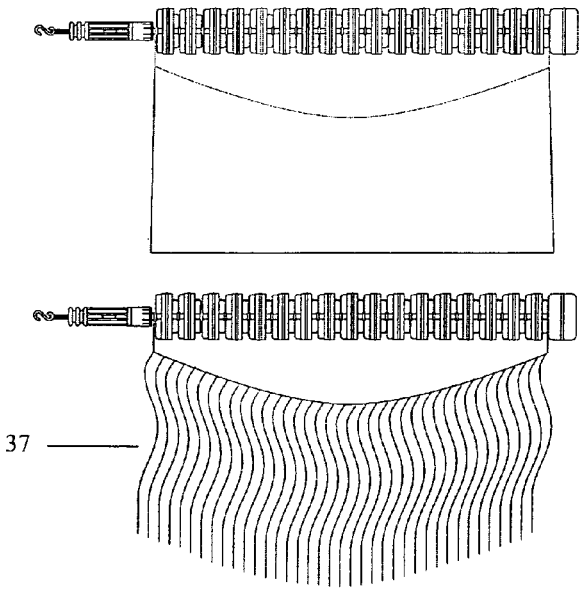
FIG. 7 shows a third embodiment of a wave inhibitor according to the second aspect of the present invention.

As shown in FIG. 6 the wave inhibitor may take the form of a mat 35 having resilient upstanding bristles 36. The length of each of the stuns or bristles my also vary.

Although the above embodiments have been described for flooring system they equally apply to panels which may be attached to side walls of the pool.

According to the third embodiment of the second aspect of the invention, a curtain of streamers 37 may be utilized as a way of dividing lanes or enhancing existing lane dividers. The curtain of streamers 37 may be formed by having a line of cable with a flexible sheet or multitude of streamers (flexible filaments) hanging therefrom into the water.

Alternatively the curtain may be completely submersed and may extend close to the bottom of the pool.

It is preferred that the curtain extends downwardly as least 2.5 meters below the surface of the water of the pool.

Figure 2:
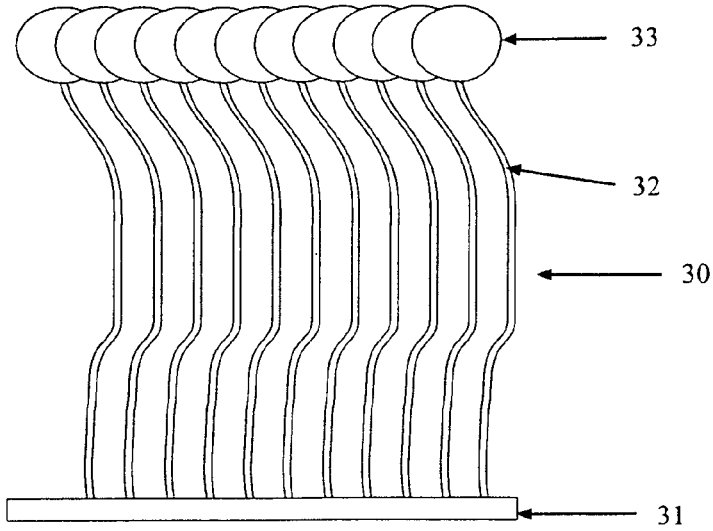
FIG. 2 shows flexible wave inhibitors according to a second aspect of the present invention.
Figure 3:
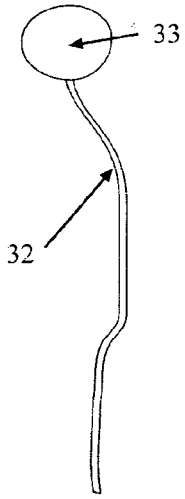
FIG. 3 shows a single flexible stem of the wave inhibitor shown in FIG. 2.
Figure 4:
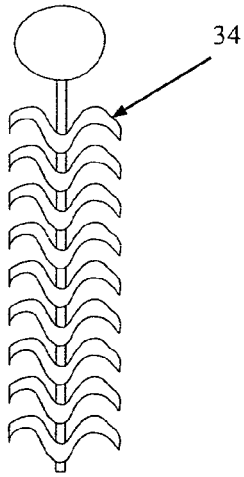
FIG. 4 shows a variation of the flexible stem shown in FIG. 3.

The streamers may be flexible elongate stems similar to those shown in relation to FIG. 2.

According to another embodiment the curtain may be in the form of a netting with a fine enough weave so that waves passing therethrough are suppressed.

The curtain may also be suspended across the floor of the pool so that there is a space between the floor and the curtain.

Figure 8:
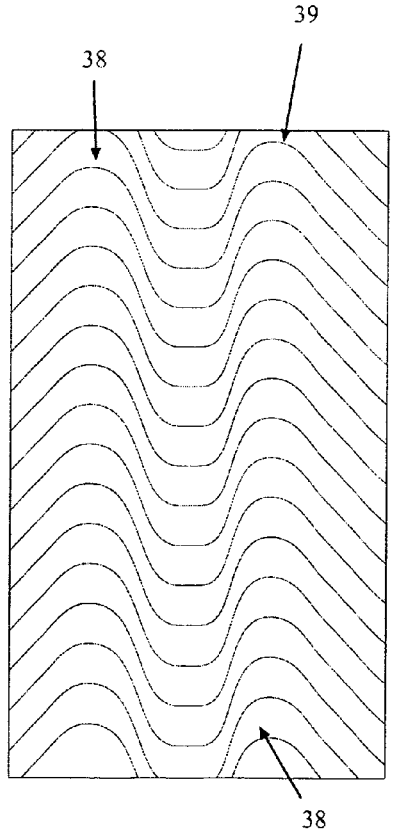
FIG. 8 shows a wave inhibitor according to a third aspect of the present invention.

As shown in FIG. 8 a third aspect of the present invention includes a contoured surface which is applied to one or more walls of the pool.

The contoured surface may be in the form a carpet or mat which has a series of ridges 38 and troughs 39. These ridges and troughs 36, 39 are arranged to extend across the pool and provide a method of inhibiting reflection of waves which move down to the bottom of the pool and would normally reflect back to the surface.

It is possible that the floor or walls of the pool are specially moulded or formed with the ridges and troughs.

Alternatively they may be in the form of panels like tiles which can be connected to the wall surface.

In use it is expected that a wave striking the surface of the textured floor would generally reflect at an angle of 45 to 90° so that the wave would dissipate in the depths of the pool rather than be reflected back to the surface.

A similar effect may be provided by having a number of closely arranged peaks and troughs arranged in an array across the wall surface.

By suppressing wave reflections using the wave inhibitor methods and devices described above the "speed" of a pool can be enhanced.

Figure 9:
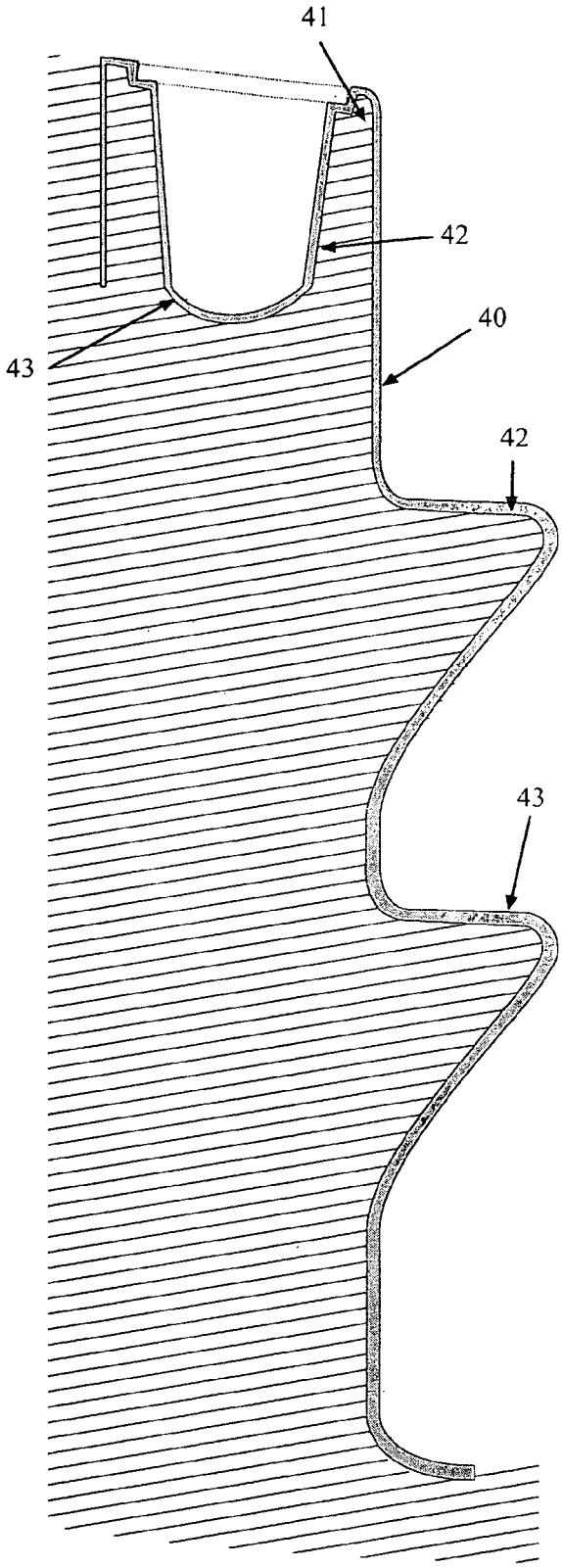
FIG. 9 shows a wall adaptor according to a fourth aspect of the present invention.

FIG. 9 shows a wall adaptor for a pool according to a fourth aspect of the present invention.

The wall adaptor is in the form of a moulded plastic or fibreglass attachment 40 which has an upper region 41 which fits over an overflow gutter of a pool and consequently is able to reshape the overflow gutter.

This adaptor 40 also has two steps 42, 43 which extend out from a generally vertically dropping wall of the adaptor 40.

The top section 41 may be in the form of a single hook over section 42 which is able to introduce an inclined wall to the gutter over which it is attached Alternatively the adaptor may extend around the whole of the gutter so as to redefine its whole shape.

By having inclined walls for the gutter 43, a reduction in trickle over noise is also produced. This is because pool gutters traditionally have squared side walls, resulting in overflow water actually dropping into the gutter. With inclined side walls the water actually flows with minimum noise.

Figure 10:
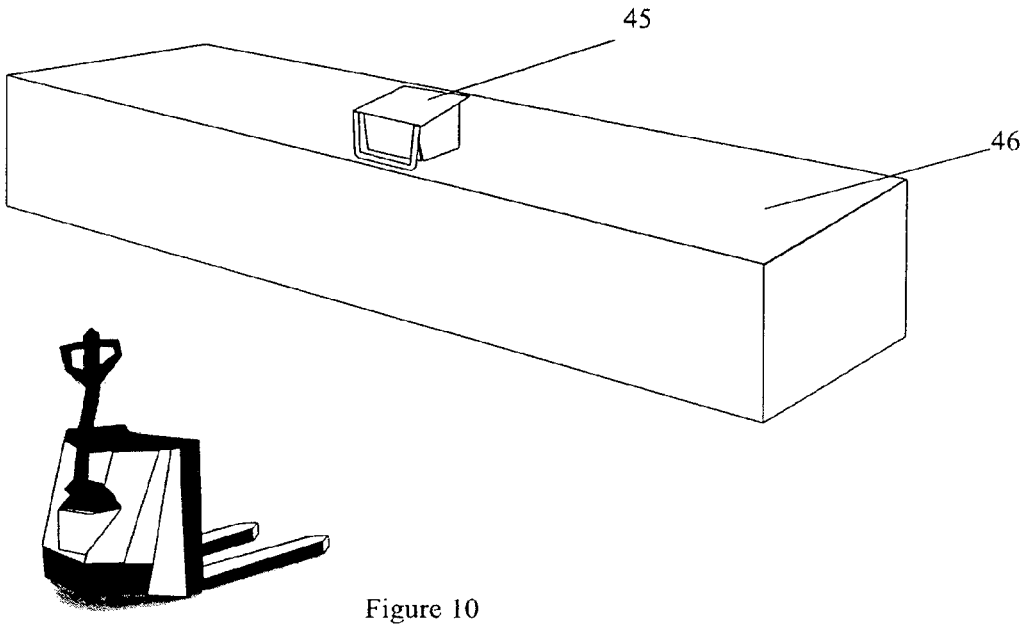
FIG. 10 shows a wall module according to a fifth aspect of the present invention.
Figure 11:
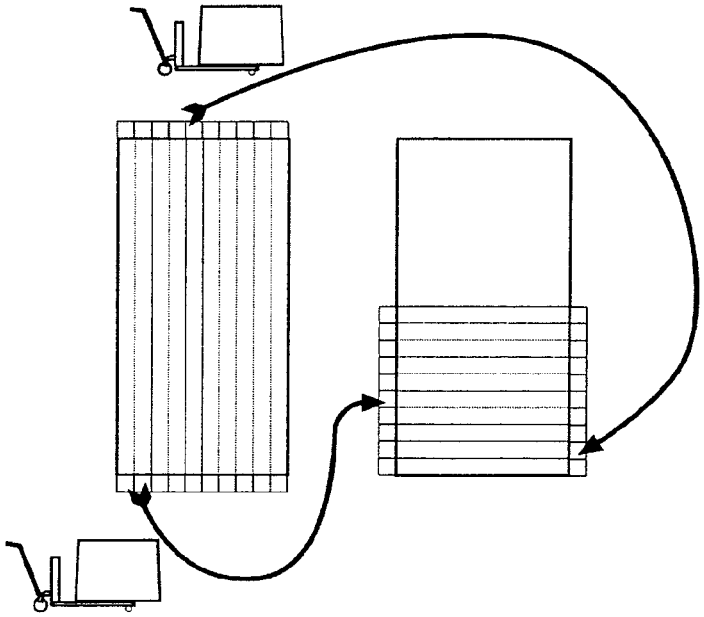
FIG. 11 shows a plan view of a number of wall modules of the type shown in FIG. 10 when placed across a pool.

FIG. 10 shows a wall module according to the fifth aspect of the present invention.

This wall module is effectively a long rectangular block 44 with starting blocks 45 on its upper surface.

The block 44 has couplings provided at each end on its underside. These couplings (not shown) may be in the form of tubular holes.

In use a forklift trolley is able to move the module 44 over a pool and across it to a particular location so that the length of the pool is reduced to a new desired length. Each end of the module 44 is positioned over holes provided around the exterior of the pool and rods may be inserted through the ends of each module so that these rods fit into receiving tubes or recesses located around the outside of the pool.

A number of modules 44 may be pushed together to cover part of the length of the pool. Only the module which is directly in front of the water has any starting blocks on it.

Alternative ways of coupling the ends of the module to some form of securing foundation are also envisaged. For example the modules may be provided with end flanges which are able to be clamped to flanges, hooks, or other securing devices located around the sides of the pool or in recesses located around the sides of the pool.

By using modules as described above, it is possible to change the length of the pool and theoretically also the width so that different types of water sports may be played. Water polo in one example of such a sport.

The shape of the modules 44 may be changed from the standard rectangular shape.

One or more modules may be provided with protruding portions which allow starting blocks to be connected thereon.

FIGS. 12 to 15 shows a starting block according to a sixth aspect of the present invention.

The starting block has a number of new features including handles 50 which assist a swimmer during a starting dive.

Figure 12:
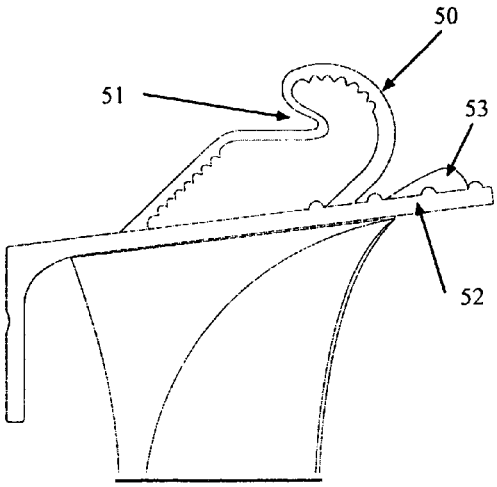
FIG. 12 shows a side view of a starting block according to a sixth aspect of the present invention.
Figure 13:
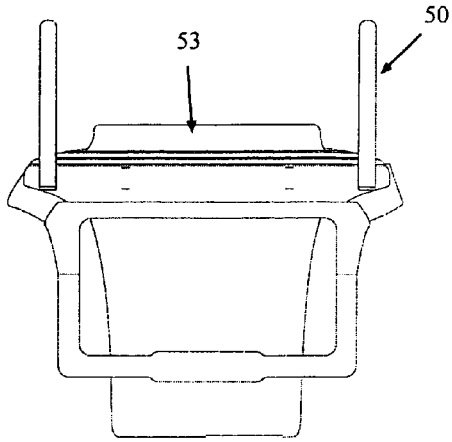
FIG. 13 shows a front view of the starting block shown in FIG. 12.
Figure 14:
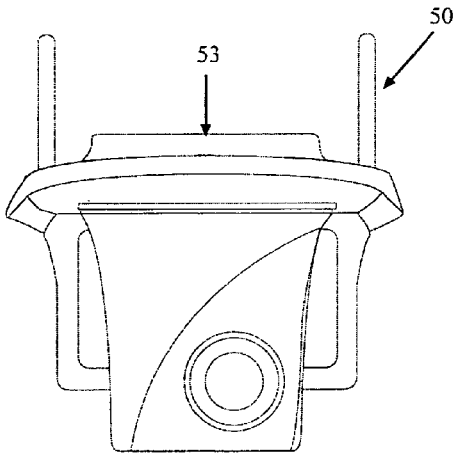
FIG. 14 shows a rearward view of the starting block shown in FIG. 12.
Figure 15:
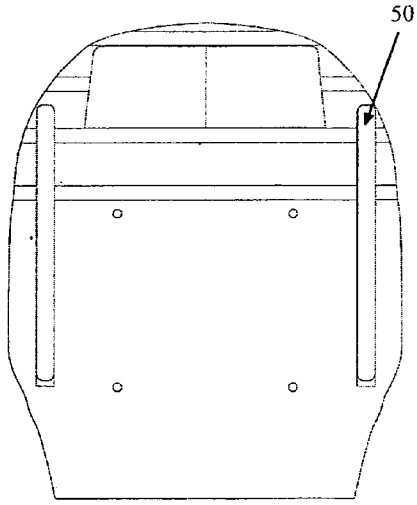
FIG. 15 shows a plan view of the starting block shown in FIG. 12.

As shown most clearly in FIG. 12 the handles 50 may be provided with a recess 51 which is shaped so that a person's hand can fit inside and rest their palm against it.

Accordingly when a swimmer is in a squatting diving position the arms may be positioned to push start against the bars, or alternatively assist in a lean start by leaning forward and hanging onto the handles in the traditional fashion. It is expected that if a swimmer is able to push start there may be an additional advantage in diving from the starting block.

According to a further embodiment the handles include a knob or similar shaped device which is contoured so that a person can hold the knob and is able to obtain a quick release from the knob by either pushing forward or leaning forward and releasing.

It is also envisaged that the handles may slide forwards or backwards on the stand 52 or alternatively the handles may slide upwardly at an angle so as to vary the height to suit a particular swimmer.

According to another embodiment the starting block also includes a foot support or base 52 which is able to telescopically increase in length or decrease in length again to suit the size of a particular swimmer. In this way the handles and base may be separately adjustable to obtain the best setting for each swimmer.

Another feature of the starting block is the provision of a heel support 53 in the form of an upright curved wall at the back of the starting block.

This heel support 53 allows a swimmer's heel to be pressed against it to prevent slippage.

In addition the heel support 53 allows a swimmer to push up against it in readiness for a dive into the pool.

The position of the heel rest 53 may be adjusted and divided into two parts in a similar fashion to heel rests for sprinters in athletics.

The starting block foot support may be made so that it is attachable or detachable so that custom made foot panels may be located on the starting block. It is preferred that the foot support is made from a non-slip material and includes a multitude of dimples to resist slipping.

Figure 16:
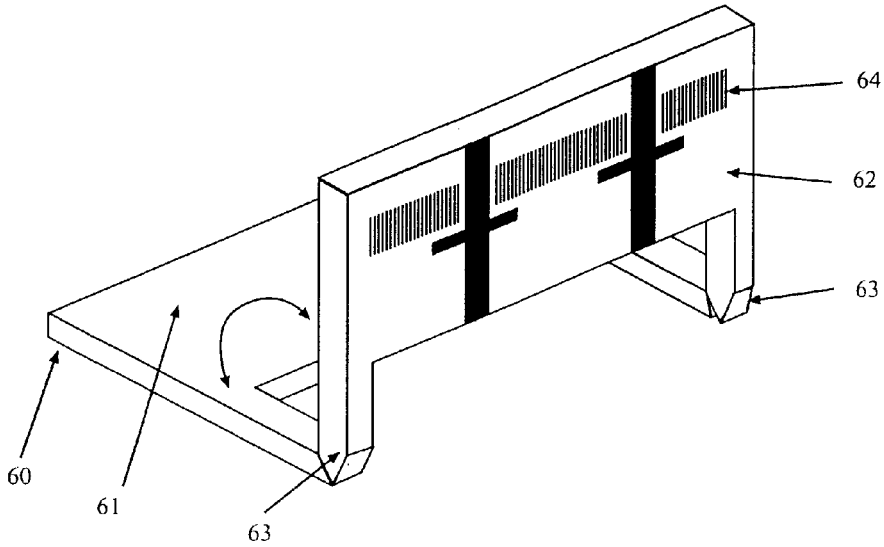
FIG. 16 shows an angled view of a pivotable swim wall module.
Figure 17:
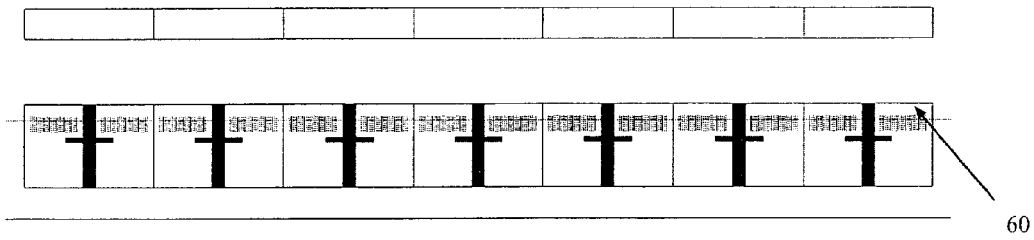
FIG. 17 shows a front view of a top portion of the module shown in FIG. 16.

As shown in FIGS. 16 and 17 a pivotable swim wall module 60 consists of first and second wall panels 61, 62.

One of the panels 61 is adapted to rest on a pool floor or be supported above it while the other panel 62 is adapted to be pivoted to a vertical disposition.

The second panel 62 also has lower side legs 63 which are hinged to corresponding lower side legs of the first panel or alternatively to a bottom wall of the first panel depending on whether the first panel is made as a complete rectangular slab or includes legs so as to allow the module to be transposable.

Figure 19:
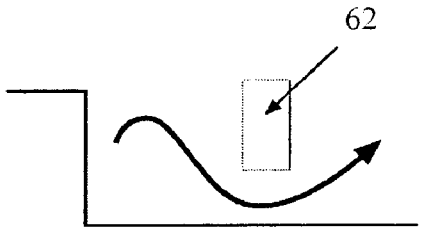
FIG. 19 shows a schematic side view of a swim wall module.

Between each of the legs 63 a space exists so that with the second panel fixed in a vertical position water is able to flow underneath the second panel as exemplified in FIG. 19.

The module includes a locking mechanism for fixing each wall panel in the right angled configuration shown in FIG. 16. This fixing means may involve girders or struts which connect over pins on the outer surface of a lower portion of each of the legs, in a similar manner to a table tennis table.

It is envisaged that pivoting of the wall panels would be achieved by using hydraulics or inflatable bags or chambers within one or both of the modules.

In its preferred form each module has a series of openings 64 which are aligned horizontally so that when one module such as a second module 62 is arranged vertically surface waves of the water in the pool are able to pass through the openings. Furthermore the height/depth of each opening may be large enough so that substantially all of the wave below the water level is also able to pass through the openings.

Preferably the openings are provided with wave suppression means or wave inhibitors which either absorb wave energy or allow waves to pass therethrough but inhibit their return.

Any of the wave inhibiting devices may be used with the wall module described above.

Figure 18A:
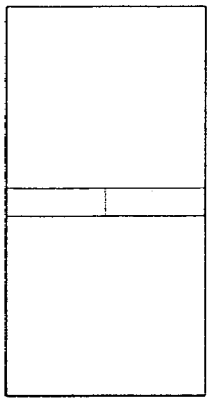
FIG. 18*a* shows one configuration of swim wall modules of FIG. 16.
Figure 18B:
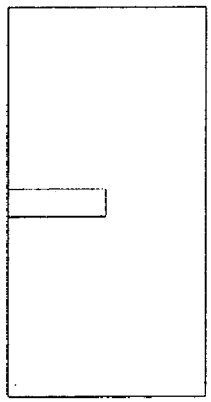
FIG. 18*b* shows another configuration of a swim wall module shown in FIG. 16.
Figure 18C:
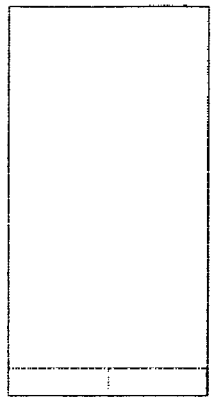
FIG. 18*c* shows a further configuration of swim wall modules as shown in FIG. 16.

As shown in FIGS. 18*a* to 18*c* wall modules may be arranged singly or together across a pool to change the dimensions of a pool. Thus a pool may be divided into half so that half may be used for one purpose and another half for a different purpose.

Similarly as shown in FIG. 18*b*, one or more lanes of a pool may be divided.

Similarly for older pools wall modules may be incorporated so that they become regulation 50 or 25 meter pools.

As shown in FIG. 19 because the wall module does not need to go to the bottom of the pool, wave turbulence is able to pass underneath the wall module 62 and is therefore in effect captured behind the wall module.

According to another aspect of the present invention a movable floor may be provided which is supported on a scissors-like hydraulic or pneumatic lifting device. The surface of the floor would be provided with damping according to any one of the embodiments previously described.

Figure 20:
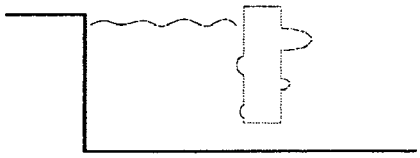
FIG. 20 shows another embodiment of the swim wall module shown in FIG. 19.

As show in FIG. 20 the wall module may be specially configured with wave inhibiting surface formations of the type previously described.

It is to be understood that, if any prior art publication is referred to herein, such reference does not constitute an admission that the publication forms a part of the common general knowledge in the art, in Australia or in any other country.

The claims defining the invention are as follows:

1. A wave inhibiting device for a pool lane divider, the device having an inner region to receive a line for securing a plurality of the devices together to form a pool lane divider, a plurality of fins extending from the inner region at substantially right angles to each other and for blocking at least a portion of any wave incident on a major surface thereof, a plurality of rings surrounding the inner region and an outer region having at least one peripheral wall portion which extends at least part way between adjacent fins and has an axially directed extension comprising a peak extending along an outer end of each fin for suppressing the amplitude of a wave striking a face of each fin.

2. The wave inhibiting device as claimed in claim 1 wherein each of the rings are connected to an adjacent ring at inner end regions of each fin.

3. The wave inhibiting device as claimed in claim 2 wherein each ring includes an axially-extending portion.

4. The wave inhibiting device as claimed in claim 3 wherein each ring has portions extending axially in opposite directions.

5. The wave inhibiting device as claimed in claim 4 wherein a ring is separated from an adjacent ring by at least one arcuate slot.

6. The wave inhibiting device as claimed in claim 5 wherein each ring is separated from an adjacent ring by a plurality of arcuate slots arranged in a ring-like pattern.

* * * * *